United States Patent [19]

Yokoya et al.

[11] Patent Number: 4,708,922

[45] Date of Patent: Nov. 24, 1987

[54] ELECTROPHOTOGRAPHIC PHOTORECEPTOR COMPRISES DIARYLAMINE PHOTOCONDUCTOR AND STYRYL DYE HAVING TERTIARY AMINO MOIETY SUBSTITUTED WITH ARYL GROUPS

[75] Inventors: Hiroaki Yokoya; Kenji Sano; Hideo Sato, all of Kanagawa, Japan

[73] Assignee: Fuji Photo Film Co., Ltd., Kanagawa, Japan

[21] Appl. No.: 929,537

[22] Filed: Nov. 12, 1986

[30] Foreign Application Priority Data

Nov. 11, 1985 [JP] Japan ..... 60-252517

[51] Int. Cl.[4] ..... G03G 5/04; G03G 5/06

[52] U.S. Cl. ..... 430/73; 430/95; 430/75

[58] Field of Search ..... 430/73, 95, 70, 75

[56] References Cited

U.S. PATENT DOCUMENTS 3,635,706 1/1972 Kampfer et al. ..... 430/95 X

*Primary Examiner*—J. David Welsh

*Attorney, Agent, or Firm*—Sughrue, Mion, Zinn, Macpeak & Seas

[57] ABSTRACT

An electrophotographic photoreceptor is disclosed. The photoreceptor contains a specific styryl dye in which the tertiary amino moiety is substituted with aryl groups and a specific organic photoconductive compound in which the nitrogen atoms are substituted with aryl groups. The photoreceptor exhibits high sensitivity and excellent preservation stability and heat stability.

12 Claims, No Drawings

ELECTROPHOTOGRAPHIC PHOTORECEPTOR COMPRISES DIARYLAMINE PHOTOCONDUCTOR AND STYRYL DYE HAVING TERTIARY AMINO MOIETY SUBSTITUTED WITH ARYL GROUPS

FIELD OF THE INVENTION

This invention relates to an electrophotographic photoreceptor. More particularly, it relates to a transparent electrophotographic photoreceptor which comprises a conductive support having formed thereon a photosensitive layer containing a specific sensitizing dye and a specific organic photoconductive compound.

BACKGROUND OF THE INVENTION

A number of organic compounds have conventionally been known as photoconductive substances for electrophotographic photosensitive materials, and some of them have been confirmed to have considerably high photosensitivity.

Organic photoconductive substances exhibit superiority in many performance properties over inorganic ones, and contribute to broadening of applied techniques in the field of electrophotography. For example, use of organic photoconductive substances has first made it possible to produce transparent light-sensitive films, flexible light-sensitive films, and light-sensitive films that are light and easy to handle. Further, organic photoconductive substances possess various characteristics that cannot be expected from inorganic photoconductive substances, such as film-forming property and surface smoothness in the production of photoreceptors, as well as selectivity of charge polarity when applied to electrophotographic copying processes, and the like. In spite of these excellent characteristics in many respects, the organic photoconductive substances have not yet made a sufficient contribution to the technical field of electrophotography, due mainly to insufficient photosensitivity thereof.

The chief study of organic photoconductive substances has been from beginning directed to compounds such as those having complicated structures, various high-molecular aromatic or heterocyclic compounds, and so on. As a result, some compounds having considerably high sensitivities have been developed. In recent years, the center of the study tends to be shifted to methods of sensitization because of organic photoconductive compound having higher sensitivity than any other compounds so far known does not have high sensitivity enough to be practically used as such without being subjected to sensitization. Therefore, in practical use of the organic photoconductive substances, it is essential to choose the most effective method of sensitization to be applied.

Commonly known methods of sensitization include addition of sensitizing dyes and addition of Lewis acids, which can be applied to almost all of the organic photoconductive substances. The former method brings about sensitization by addition of spectral absorption characteristics of the dye to the organic photoconductive substance, and the latter method achieves sensitization through manifestation of new spectral sensitivity due to formation of a complex between the organic photoconductive substance and a donor acceptor (C-T band).

However, photosensitivity obtained by these conventional sensitization methods is still insufficient. Besides, the thus sensitized electrophotographic photoreceptors often undergo serious reduction in electrophotographic performance properties, such as photosensitivity, depending on conditions of preservation. In particular, when photoreceptors sensitized with dyes are preserved under high temperature and high humidity conditions, the sensitizing dyes decompose (discoloration) to reduce their sensitizing capability, which results in reduction of photosensitivity of the photoreceptors. The above-mentioned problem on preservation stability results in a serious hindrance to practical application of organic photoconductive substances to electrophotographic photosensitive materials.

In the light of the above-described circumstances, the inventors have developed electrophotographic photoreceptors sensitized with styryl dyes as disclosed in Japanese Patent Application (OPI) Nos. 164588/84 and 163047/85 (the term "OPI" as used herein means "unexamined published patent application"). Although these styryl dyes have succeeded to broaden the photosensitive wavelength regions and to improve photostability of photoreceptors, the problem of long-term stability of the photoreceptors has not yet come to a satisfactory solution.

SUMMARY OF THE INVENTION

One object of this invention is to provide an organic electrophotographic photoreceptor having high sensitivity, excellent preservation stability and heat stability.

Another object of this invention is to provide an electrophotographic light-sensitive material which can be put into industrially practical use as a transparent electrophotographic light-sensitive film, a flexible electrophotographic light-sensitive film, or an electrophotographic light-sensitive film that is light and easy to handle.

The inventors have conducted extensive and intensive investigations with the purpose of improving electrophotographic performance properties, particularly long-term stability, of electrophotographic photoreceptors, while retaining satisfactory performances of the styryl dyes as disclosed in Japanese Patent Application (OPI) No. 164588/84. As a result, it has now been found that the above objects can be accomplished by a combination of specific styryl dyes and specific organic photoconductive compounds.

The present invention is thus directed to an electrophotographic photoreceptor comprising a conductive support having formed thereon a photosensitive layer containing a styryl dye represented by formula (I) and an organic photoconductive compound represented by formula (II).

Formula (I) is represented by

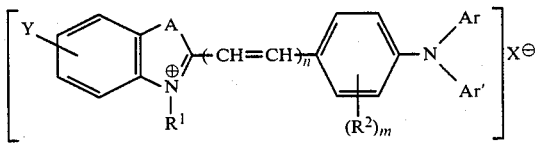

wherein A represents

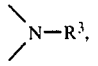

O, S, Se or

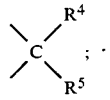

$R^2$ represents a hydrogen atom, a substituted or unsubstituted alkyl group, an alkoxy group, an acryloxy group, a nitro group, or a halogen atom; $R^3$, $R^4$ and $R^5$ each represents a hydrogen atom or a substituted or unsubstituted alkyl group; $R^1$ represents a substituted or unsubstituted alkyl group; Ar and Ar' each represents a substituted or unsubstituted aryl group; the substituent of the substituted alkyl group as represented by $R^1$ or $R^2$ or the substituted aryl group as represented by Ar or Ar' is selected from an alkyl group, a halogen atom, a cyano group, a nitro group, a trifluoromethyl group, an alkoxycarbonyl group, a substituted carbonyloxy group, a carbonyl group, an alkoxy group, an amido group, and a sulfonamido group; Y represents a hydrogen atom, an alkyl group, a halogen atom, a cyano group, a nitro group, a trifluoromethyl group, an alkoxycarbonyl group, an alkyl-substituted carbonyloxy group, a carbonyl group, an alkoxy group, an amido group, or a sulfonamido group; $X^-$ represents an anion; and n and m each represents 1 or 2.

Formula (II) is represented by

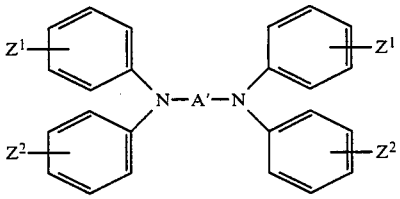

wherein $Z^1$ and $Z^2$ each represents a hydrogen atom, an alkyl group having from 1 to 4 carbon atoms or a halogen atom; and A' represents a monocyclic divalent aromatic group, a condensed or linearly bonded polycyclic divalent aromatic group, a divalent aromatic group having a condensed heterocyclic ring or a substituted divalent aromatic group of any of the above-described types, wherein the substituent is selected from an acyl group having from 1 to 6 carbon atoms, an alkyl group having from 1 to 6 carbon atoms, an alkoxy group having from 1 to 6 carbon atoms, a nitro group, and a halogen atom.

DETAILED DESCRIPTION OF THE INVENTION

In the above-described formula (I), the substituted or unsubstituted alkyl group as represented by $R^2$, $R^3$, $R^4$ or $R^5$ is preferably a straight or branched chain alkyl group having from 1 to 5 carbon atoms. The alkoxy group as represented by $R^2$ is preferably a straight or branched chain alkoxy group having from 1 to 5 carbon atoms. The substituted or unsubstituted alkyl group as represented by $R^1$ is preferably a substituted or unsubstituted straight or branched chain alkyl group having from 1 to 8 carbon atoms.

When Y represents an alkyl group, an alkoxycarbonyl group, an alkyl-substituted carbonyloxy group, a carbonyl group or an alkoxy group, these groups may be substituted with a halogen atom, a cyano group, etc.

Specific examples of X include a halogen atom, $ClO_4$,

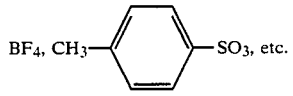

The styryl dyes represented by formula (I) according to the present invention can be synthesized by conventionally known processes. For example, they can be synthesized easily by condensing a compound of formula (III) and a compound of formula (IV) in an alcohol in the presence of piperizine or in acetic anhydride under heating.

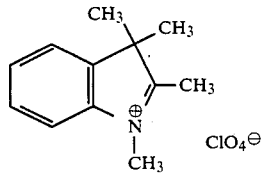

(III)

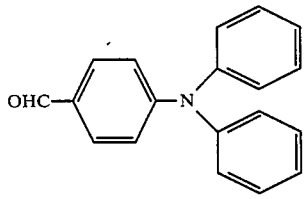

(IV)

In addition, the styryl dyes of formula (I) can also be synthesized easily in accordance with the descriptions of *J. Chem. Soc.*, Vol. 123, pp. 2288–2296 (1923), etc.

Specific examples of the styryl dyes according to the present invention are shown below:

(1)
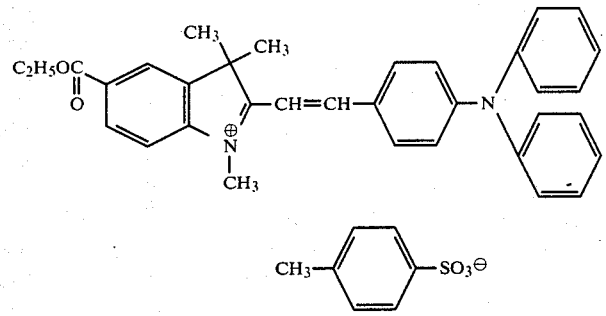
(2)
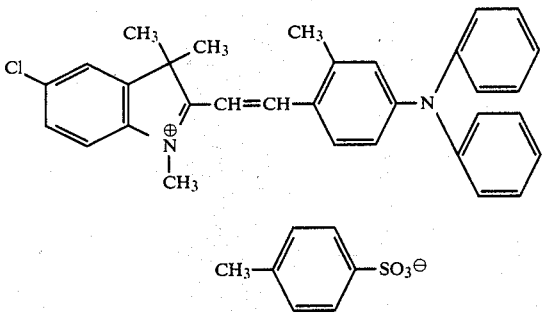
(3)
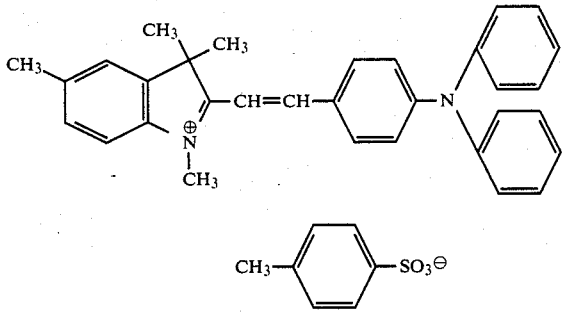
(4)
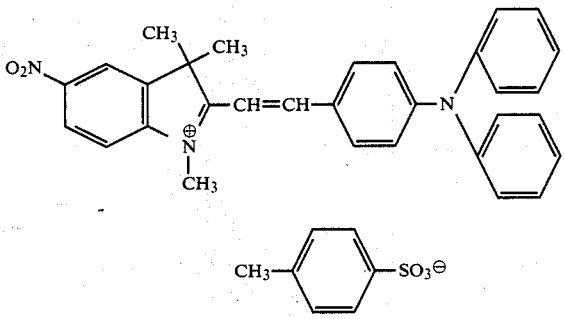
(5)
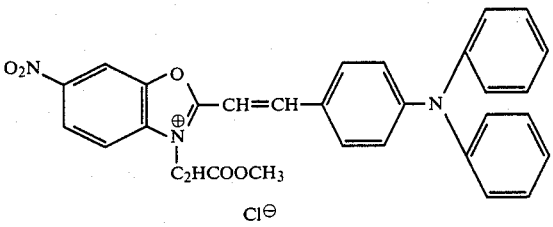
(6)
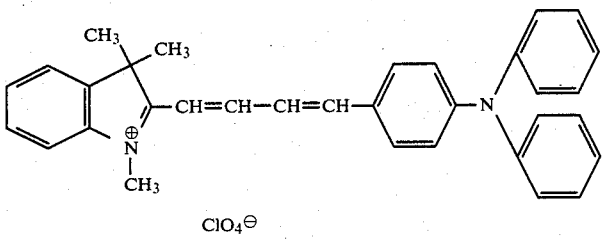
(7)
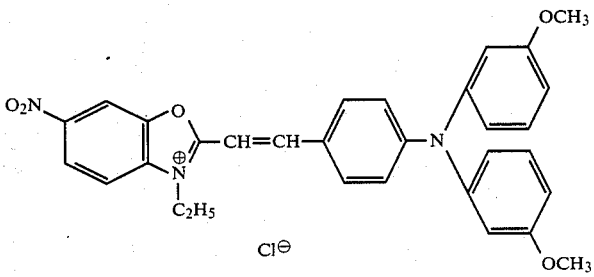

-continued (8)

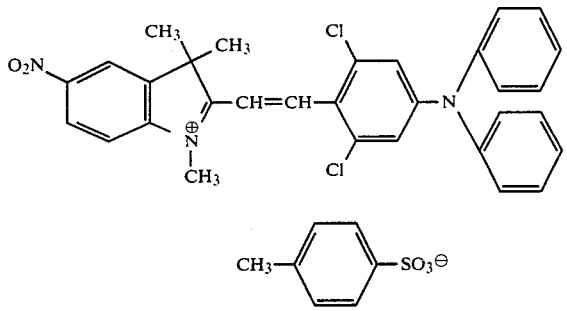

(9)

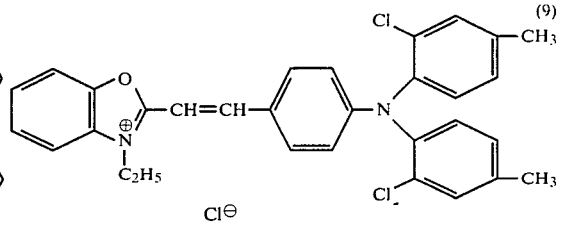

(10)

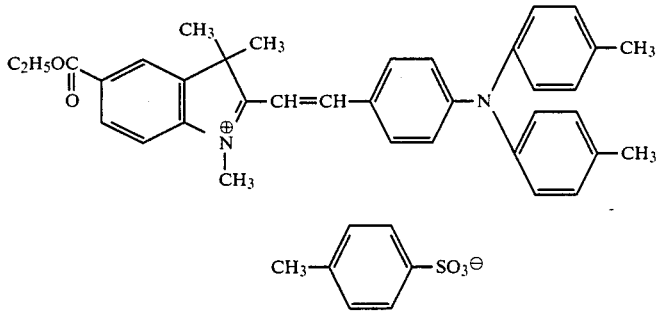

The organic photoconductive compounds represented by formula (II) according to this invention are diarylamine compounds that can be synthesized by conventionally known processes, i.e., by the reaction between aromatic amines and aryl halides.

In the cases when the halides are iodides or bromides, the reaction is carried out in an alkaline medium, such as potassium carbonate dissolved in nitrobenzene, in the presence of a copper powder. Such a reaction is described in detail in *J. Am. Chem. Soc.,* Vol. 48, p. 2882 (1926). In the cases when the halides are chlorides, the reaction can be effected by heating under pressure as described in *Berichte der Dentchen Chemichen Gesellschaft,* Vol. 32, pp. 1912 and 1914 (1899).

Specific examples of the organic photoconductive compounds of this invention are shown below:

(11)

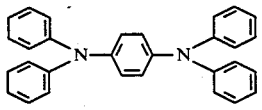

(12)

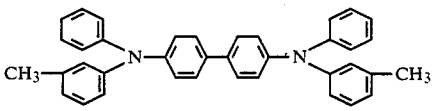

(13)

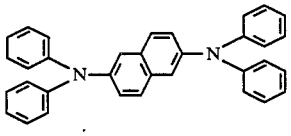

(14)

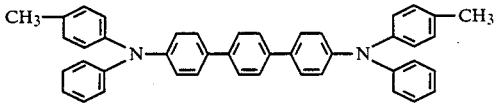

-continued (15)

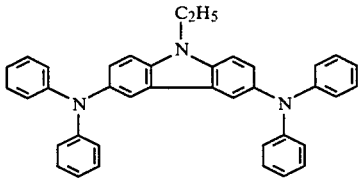

(16)

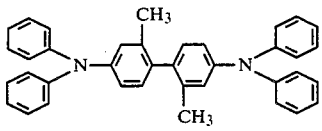

According to the experiments conducted by the inventors, it has been found that the preservation stability and heat stability of organic electrophotographic photoreceptors depend on the properties of the organic photoconductive compounds and sensitizing dyes used.

For example, when an organic photoconductive compound used is a highly basic substance, such as triphenylmethane compounds, pyrazoline compounds or alkyl-substituted hydrazone compounds as disclosed in British Patent No. 984,965 and Japanese Patent Application (OPI) Nos. 72231/77 and 59143/79 and compounds wherein moieties corresponding to

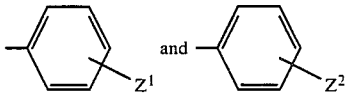

are not aryl groups, but rather substituted or unsubstituted alkyl groups, decomposition of sensitizing dyes proceeds rapidly so that the resulting electrophotographic photoreceptors have insufficient preservability and heat stability. On the other hand, the present inventors have found that when the diarylamine compounds of formula (II) in which the nitrogen atom is substituted with aromatic groups so as to have reduced basicity are used as photoconductive substances, decomposition of dyes is suppressed.

However, when the alkyl-substituted styryl dyes as disclosed in Japanese Patent Application (OPI) No. 164558/84 are employed, their stability is still insufficient, producing only unsatisfactory electrophotographic photoreceptors even when using the diarylamine compounds of the present invention as organic photoconductive compounds. In accordance with the present invention, use of styryl dyes in which the tertiary amino moiety is substituted with aryl groups so as to have reduced basicity similarly to the above-described diarylamine compounds makes it possible to obtain organic electrophotographic photoreceptors excellent in preservation stability and heat stability.

Thus, the notable improvement in preservation stability and heat stability of organic electrophotographic photoreceptors can first be achieved by the combined use of the specific styryl dyes and specific diarylamine type organic photoconductive compounds. As shown in Examples hereinafter given, individual use of each of these elements fails to provide sufficient preservation stability and heat stability.

The diarylamine compounds which can be used in the present invention have many aromatic groups and thereby have a very wide $\pi$-electron cloud. Therefore, when molecules overlap each other, the $\pi$-electrons are easily shifted from molecular to molecule. This is believed to be a reason for the high photoconductivity of the diarylamine compounds of the present invention. Hence, the diarylamine compounds in which the nitrogen atoms have aryl substituents have a broader $\pi$-electron cloud than those compounds in which the nitrogen atoms are substituted with alkyl groups, thereby bringing about higher electrophotographic sensitivities.

Styryl dyes in which the tertiary amino moiety is substituted with an alkyl group do not exhibit sufficient electrophotographic sensitivity even if the diarylamine compounds of the invention are employed, as shown in Examples hereinafter given. It can be seen, therefore, that organic electrophotographic photoreceptors having the desired high electrophotographic sensitivity can be obtained by using a combination of the sensitizing dyes and organic photoconductive compounds in accordance with the present invention.

Thus, not only the great improvement in preservation stability and heat stability of electrophotographic photoreceptors, but also the improvement in electrophotographic sensitivity of the photoreceptors can be accomplished by the combined use of the specific styryl dyes and specific diarylamine type organic photoconductive compounds of the invention.

The electrophotographic photoreceptors according to the present invention can be produced by dissolving the organic photoconductive compound in a solution of a binder and then dissolving the styryl dye in the resulting solution to prepare a coating composition, and coating the composition on a conductive support, followed by drying to form a photosensitive layer.

The thickness of the photosensitive layer is generally from about 3 to about 50 $\mu$m, and preferably from 5 to 20 $\mu$m. The organic photoconductive compound is present in the photosensitive layer in an amount of from 10 to 90% by weight, and preferably from 30 to 70% by weight, based on the total solids content of the photosensitive layer.

The amount of the styryl dye to be used in the present invention ranges from about 0.01 to about 100 parts by weight, and preferably from about 0.1 to 30 parts by weight, per 100 parts by weight of the organic photoconductive compound.

In the present invention, the diarylamine type organic photoconductive compounds of the invention may be used in combination with other conventionally known organic photoconductive compounds, provided that such combined use does not depart from the scope of the present invention.

Binders which can be used in the photoreceptors include condensed resins, such as polyamides, polyurethanes, polyesters, epoxy resins, polyketones, polycarbonates, etc., and vinyl polymers, such as polystyrene, polyacrylates, polymethacrylates, polyacrylamide, poly-N-vinylcarbazole, etc. In addition, any of electrically insulating resins may also be employed.

The photoreceptors of the present invention can further contain a plasticizer in addition to the binder. Examples of the plasticizers to be used include biphenyl, biphenyl chloride, o-terphenyl, p-terphenyl, diethyl phthalate, dibutyl phthalate, dioctyl phthalate, dibutyl sebacate, dioctyl sebacate, benzophenone, dimethylnaphthalene, and the like.

The photoreceptors may contain additives for increasing electrophotographic sensitivity, such as those described in Japanese Patent Application (OPI) Nos. 64539/83, 102239/83 and 102240/83.

For the purpose of stably coating a photosensitive layer and improving coating surface properties, other additives, such as surface active agents, may also be used.

Conductive supports which can be used may be any of materials having a visible light transmittance of at least 50%, and preferably at least 70%, and having an electrically conductive surface. Such supports can be formed, for example, by vacuum-depositing a metal or metal oxide, e.g., palladium, gold, indium oxide, tin oxide, etc., on a plastic film or coating such a metal or metal oxide together with a binder on a plastic film.

An adhesive layer or a blocking layer may be provided between the conductive support and the photosensitive layer in order to improve adhesion. Further, a protective layer may also be provided on the surface of the photoreceptors.

The invention is illustrated in greater detail with reference to the following examples, but it should be understood that the examples are not intended to limit the present invention.

EXAMPLE 1

In 80 ml of methylene chloride, 6 g of Compound (12) as a photoconductive substance, $1\times10^{-4}$ mol of Compound (1) as a styryl dye, and 10 g of polycarbonate ("LEXAN 121" produced by G.E. Co.) as a binder were dissolved, to prepare a photosensitive composition. The composition was coated with a wire bar on a 100 $\mu$m thick polyethylene terephthalate film having a palladium deposite film (thickness of 30 Å, formed by sputtering), followed by drying to produce a transparent electrophotographic photoreceptor having a thickness of 6 $\mu$m. This photoreceptor was designated as Sample No. 1.

EXAMPLE 2

A transparent electrophotographic photoreceptor (Sample No. 2) was produced in the same manner as in Example 1, except for using Compound (11) in place of Compound (12).

EXAMPLE 3

A transparent electrophotographic photoreceptor (Sample No. 3) was produced in the same manner as in Example 1, except for using Compound (13) in place of Compound (12).

EXAMPLE 4

A transparent electrophotographic photoreceptor (Sample No. 4) was produced in the same manner as in Example 1, except for using Compound (4) in place of Compound (1).

EXAMPLE 5

A transparent electrophotographic photoreceptor (Sample No. 5) was produced in the same manner as in Example 1, except for using Compound (5) in place of Compound (1).

EXAMPLE 6

A transparent electrophotographic photoreceptor (Sample No. 6) was produced in the same manner as in Example 1, except for using Compound (7) in place of Compound (1) and using Compound (14) in place of Compound (12).

COMPARATIVE EXAMPLE 1

A transparent electrophotographic photoreceptor (Sample No. 7) was produced in the same manner as in Example 5, except for replacing Compound (12) with a triphenylmethane compound represented by formula (A):

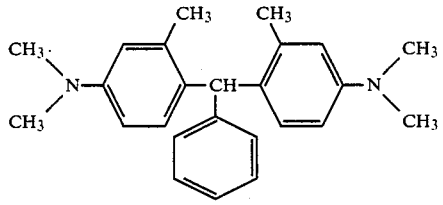

(A)

COMPARATIVE EXAMPLE 2

A transparent electrophotographic photoreceptor (Sample No. 8) was produced in the same manner as in Example 4, except for replacing Compound (12) with a pyrazoline compoun represented by formula (B):

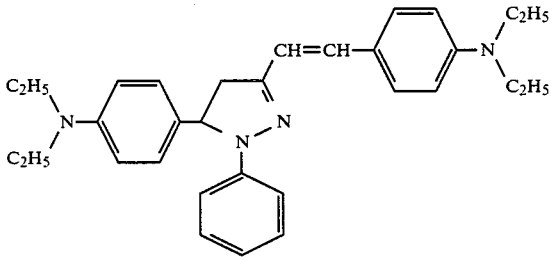

COMPARATIVE EXAMPLE 3

A transparent electrophotographic photoreceptor (Sample No. 9) was produced in the same manner as in Example 1, except for replacing Compound (12) with an alkyl-substituted hydrazone compound represented by formula (C):

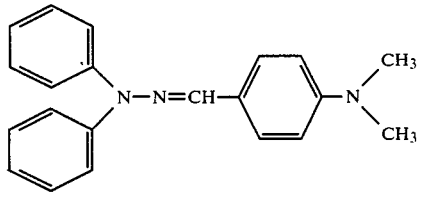

(C)

COMPARATIVE EXAMPLE 4

A transparent electrophotographic photoreceptor (Sample No. 10) was produced in the same manner as in Example 1, except for replacing Compound (12) with a diarylamine compound represented by formula (D):

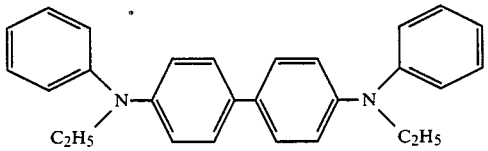

(D)

COMPARATIVE EXAMPLE 5

A transparent electrophotographic photoreceptor (Sample No. 11) was produced in the same manner as in Example 1, except for replacing Compound (1) with an alkyl-substituted styryl dye represented by formula (E):

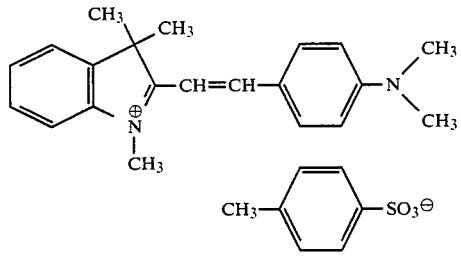

(E)

Each of Sample Nos. 1 to 11 was preserved at 50° C. and 80% RH for 1 month, and the degree of decomposition of the dye used was determined by means of an automatic recording spectrophotometer (Model 330, manufactured by Hitachi, Ltd.). The percent decomposition was obtained from the following formula:

$$\text{Percent Decomposition (\%)} = \frac{\text{Initial Density} - \text{Density After Preservation}}{\text{Initial Density}} \times 100$$

The results obtained are shown in Table 1. It can be seen from these results that the electrophotographic photoreceptors according to the present invention undergo substantially no decomposition of the dye as compared with the comparative samples, and have, therefore, excellent preservation stability and heat stability without being accompanied by substantial reduction in electrophotographic sensitivity.

TABLE 1

| Sample No. | Dye | Organic Photoconductive Compound | Percent Decomposition (%) | Remark |
|---|---|---|---|---|
| 1 | (1) | (12) | 10% or less | Invention |
| 2 | (1) | (11) | 10% or less | Invention |
| 3 | (1) | (13) | 10% or less | Invention |
| 4 | (4) | (12) | 10% or less | Invention |
| 5 | (5) | (12) | 10% or less | Invention |
| 6 | (7) | (14) | 10% or less | Invention |
| 7 | (5) | (A) | 50% or more | Comparison |
| 8 | (4) | (B) | between 10% and 50% | Comparison |
| 9 | (1) | (C) | between 10% and 50% | Comparison |
| 10 | (1) | (D) | between 10% and 50% | Comparison |
| 11 | (E) | (12) | between 10% and 50% | Comparison |

In order to evaluate electrophotographic sensitivity of the photoreceptors, each of Sample Nos. 1 and 9 to 11 was electrostatically charged by corona discharge and exposed to light at an illuminance of 4 lux by the use of a copying paper testing apparatus (Model SP-428, manufactured by Kawaguchi Denki K.K.). The sensitivity was evaluated from an exposure $E_{50}$ (lux sec) required for half light decay.

The results obtained are shown in Table 2 below. It can be seen from Table 2 that the electrophotographic photoreceptor according to the present invention exhibits higher sensitivity than the comparative samples.

TABLE 2

| Sample No. | Dye | Organic Photoconductive Compound | $E_{50}$ (lux sec) | Remark |
|---|---|---|---|---|
| 1 | (1) | (12) | 42 | Invention |
| 4 | (4) | (12) | 30 | Invention |
| 9 | (1) | (C) | 136 | Comparison |
| 10 | (1) | (D) | 120 | Comparison |
| 11 | (E) | (12) | 160 | Comparison |

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a conductive support having formed thereon a photosensitive layer containing a styryl dye represented by formula (I)

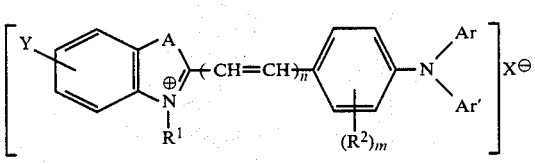

(I)

wherein A represents

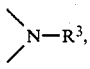

O, S, Se or

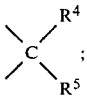

$R^2$ represents a hydrogen atom, a substituted or unsubstituted alkyl group, an alkoxy group, an aryloxy group, a nitro group, or a halogen atom; $R^3$, $R^4$ and $R^5$ each represents a hydrogen atom or a substituted or unsubstituted alkyl group; $R^1$ represents a substituted or unsubstituted alkyl grup; Ar and Ar' each represents a substituted or unsubstituted aryl group; the substituent of the substituted alkyl group as represented by $R^1$ or $R^2$ or the substituted aryl group as represented by Ar or Ar' is selected from an alkyl group, a halogen atom, a cyano group, a nitro group, a trifluoromethyl group, an alkoxycarbonyl group, a substituted carbonyloxy group, a carbonyl group, an alkoxy group, an amido group, and a sulfonamido group; Y represents a hydrogen atom, an alkyl group, a halogen atom, a cyano group, a nitro group, a trifluoromethyl group, an alkoxycarbonyl group, an alkyl-substituted carbonyloxy group, a carbonyl group, an alkoxy group, an amido group, or a sulfonamido group; $X^-$ represents an anion; and n and m each represents 1 or 2, and an organic photoconductive compound represented by formula (II)

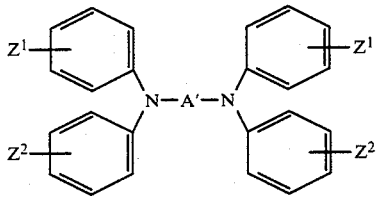

(II)

wherein $Z^1$ and $Z^2$ each represents a hydrogen atom, an alkyl group having from 1 to 4 carbon atoms or a halogen atom; and A' represents a monocyclic divalent aromatic group, a condensed or linearly bonded polycyclic divalent aromatic group, a divalent aromatic group having a condensed heterocyclic ring or a substituted divalent aromatic group of any of the above-described types, wherein the substituent is selected from an acyl group having from 1 to 6 carbon atoms, an alkyl group having from 1 to 6 carbon atoms, an alkoxy group having from 1 to 6 carbon atoms, a nitro group, and a halogen atom.

2. An electrophotographic photoreceptor as in claim 1, wherein said organic photoconductive compound is present in an amount of from 10 to 90% by weight based on the total solids content of a photosensitive layer.

3. An electrophotographic photoreceptor as in claim 2, wherein said organic photoconductive compound is present in an amount of from 30 to 70% by weight based on the total solids content of a photosensitive layer.

4. An electrophotographic photoreceptor as in claim 1, wherein said styryl dye is present in an amount of from about 0.01 to about 100 parts by weight per 100 parts by weight of the organic photoconductive compound.

5. An electrophotographic photoreceptor as in claim 4, wherein said styryl dye is present in an amount of from about 0.1 to about 30 parts by weight per 100 parts by weight of the organic photoconductive compound.

6. An electrophotographic photoreceptor as in claim 2, wherein said styryl dye is present in an amount of from about 0.01 to about 100 parts by weight per 100 parts by weight of the organic photoconductive compound.

7. An electrophotographic photoreceptor as in claim 3, wherein said styryl dye is present in an amount of from about 0.1 to about 30 parts by weight per 100 parts by weight of the organic photoconductive compound.

8. An electrophotographic photoreceptor as in claim 1, wherein the thickness of the photosensitive layer is from 5 to 20 μm.

9. An electrophotographic photoreceptor as in claim 6, wherein the thickness of the photosensitive layer is from 5 to 20 μm.

10. An electrophotographic photoreceptor as in claim 7, wherein the thickness of the photosensitive layer is from 5 to 20 μm.

11. An electrophotographic photoreceptor as in claim 1, wherein X represents $ClO_4$, BF or

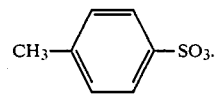

12. An electrophotographic photoreceptor as in claim 1, wherein said conductive support has a visible light transmittance of at least 50%.

* * * * *